US007559717B2

(12) United States Patent
Salas

(10) Patent No.: US 7,559,717 B2
(45) Date of Patent: Jul. 14, 2009

(54) SUBTERRANEAN CONDUIT COVER

(76) Inventor: Gary W. Salas, 11031 Hard Rock Rd., Austin, TX (US) 78750

( * ) Notice: Subject to any disclaimer, the term of this patent is extended or adjusted under 35 U.S.C. 154(b) by 29 days.

(21) Appl. No.: 11/811,849

(22) Filed: Jun. 12, 2007

(65) Prior Publication Data

US 2008/0310914 A1 Dec. 18, 2008

(51) Int. Cl.
*E02D 29/14* (2006.01)

(52) U.S. Cl. ..... 404/25; 52/19; 220/787

(58) Field of Classification Search ..... 404/25, 404/26; 215/370, 376, 200, 316; 49/449, 49/49; 138/90, 96 R, 96 T; 220/787, 789, 220/801, 484; 137/371; 52/19, 20; 405/40–42
See application file for complete search history.

(56) References Cited

U.S. PATENT DOCUMENTS 1,491,325 A 4/1924 Thomas, Jr.
1,770,057 A * 7/1930 Anderson ..... 215/200
2,497,827 A * 2/1950 Trafton ..... 220/787
2,697,389 A 12/1954 Hackman ..... 94/35
3,370,615 A 2/1968 Shinzo Tamaki et al. .. 138/96 R
3,674,149 A * 7/1972 Donalson ..... 210/163
3,920,347 A * 11/1975 Sauriol et al. ..... 404/25
3,996,966 A 12/1976 Princell ..... 138/89
4,048,766 A * 9/1977 Dantzer et al. ..... 52/19
4,060,100 A 11/1977 Miller et al. ..... 138/89
4,203,686 A * 5/1980 Bowman ..... 404/25
RE30,326 E * 7/1980 van Buren, Jr. ..... 220/326
4,363,420 A 12/1982 Andrews ..... 220/307
4,504,009 A 3/1985 Boik et al. ..... 229/5.5
4,534,088 A * 8/1985 Ricke ..... 24/295
4,667,449 A 5/1987 Keating et al. ..... 52/213
4,761,319 A 8/1988 Kraus et al. ..... 428/99
4,834,290 A 5/1989 Bailey ..... 239/205
4,861,186 A * 8/1989 Ferns ..... 404/25
4,883,194 A * 11/1989 Fernandes ..... 220/787
4,969,566 A * 11/1990 Rogers ..... 215/287
5,224,514 A 7/1993 Taylor ..... 138/89
5,312,202 A * 5/1994 Newton ..... 404/25
5,337,792 A 8/1994 Tempel ..... 138/96 R
5,351,718 A 10/1994 Barton ..... 138/92
5,378,078 A 1/1995 Lewis et al. ..... 404/25
5,454,479 A 10/1995 Kraus ..... 220/307
5,503,189 A 4/1996 Lamendola ..... 138/96 R
5,505,324 A * 4/1996 Danico ..... 220/201
5,551,191 A * 9/1996 Maiwandi ..... 49/465
5,558,346 A * 9/1996 Hartery ..... 220/787
5,658,110 A * 8/1997 Kraus ..... 411/510
5,702,133 A * 12/1997 Pavur et al. ..... 292/80

(Continued)

*Primary Examiner*—Raymond W Addie
(74) *Attorney, Agent, or Firm*—Chris Whewell

(57) ABSTRACT

Provided herein are covers useful for covering the open end of an access conduit that may contain fluid control equipment. A cover according to the invention comprises a disc-shaped base portion having a top surface and a bottom surface, with a plurality of risers attached to its bottom surface. There is a contact shoe associated with each of the risers, and the contact shoes have a curvature and are disposed sufficiently on the bottom surface of the base portion so as to exert an outward mechanical force against the inner wall of a conduit that is capped by a cover according to the invention, when such cover is in its installed position, thus providing a secure, yet conveniently removable access cover/conduit assembly.

15 Claims, 6 Drawing Sheets

U.S. PATENT DOCUMENTS

| | | | | |
|---|---|---|---|---|
| 5,845,442 | A | 12/1998 | Strehlow | 52/302.7 |
| 6,109,822 | A | 8/2000 | Campbell et al. | 404/25 |
| 6,612,082 | B2 | 9/2003 | Schimmelpfennig et al. | 52/300 |
| 6,683,247 | B1 | 1/2004 | McTavish et al. | 174/45 |
| 6,769,834 | B1 * | 8/2004 | Stange | 404/25 |
| 6,887,012 | B1 * | 5/2005 | Zappe | 404/25 |
| 2006/0201957 | A1 * | 9/2006 | Harrington et al. | 220/787 |
| 2007/0164030 | A1 * | 7/2007 | Kearby et al. | 220/300 |
| 2008/0128149 | A1 | 6/2008 | Kearby et al. | 174/66 |

* cited by examiner

SUBTERRANEAN CONDUIT COVER

TECHNICAL FIELD

This invention relates generally to means for accessing subterranean conduits, which may include plumbing controls. More particularly, it relates to a cover, which is useful for covering conduits.

BACKGROUND

Access conduits are frequently employed, where it is desired to have access to a control device, such as a valve associated with, for example, a sprinkler system in a residential or commercial lawn setting. In such applications, there exist a network of pipes through which water may flow during the normal course of providing irrigating water to such lawns, and often it is convenient for the field technician to have the ability to relieve water pressure from a particular segment of such a sprinkler system. Hence, there are often cases where it is desirous to have a shutoff valve disposed along a distribution line in such a system, in a subterranean location. Accordingly, to protect control equipment such as valves from corrosion or other attack by the elements over time, subterranean conduits have been developed, which are generally enclosures which may be buried in the ground, and within the confines of which a control device such as a valve may be housed to be protected from environmental factors. It is desirable for a field technician to have ready access to such valves, and typically the opening at the terminal end of a tubular access conduit has a flat lid which is placed over it, which may be removed as desired.

SUMMARY OF THE INVENTION

Provided herein are covers useful for covering an open terminal end of an access conduit. Such covers include a substantially-circular, disc-shaped base portion having a top surface, a bottom surface, and a circumferential edge. There is also a circular rib disposed on the bottom surface of the base portion. The circular rib itself has a top surface which is in a raised disposition with respect to the bottom surface. The circular rib forms a ring of raised elevation on said bottom surface. There are a plurality of risers attached to and extending upwardly from the circular rib. There are also a plurality of contact shoes, each of which contact shoes are attached to one and only one of the risers. The contact shoes have a convex outer surface, and a curvature which is different from the curvature of the circular rib, when the cover is viewed from the bottom perspective.

DETAILED DESCRIPTION

Figure 1:
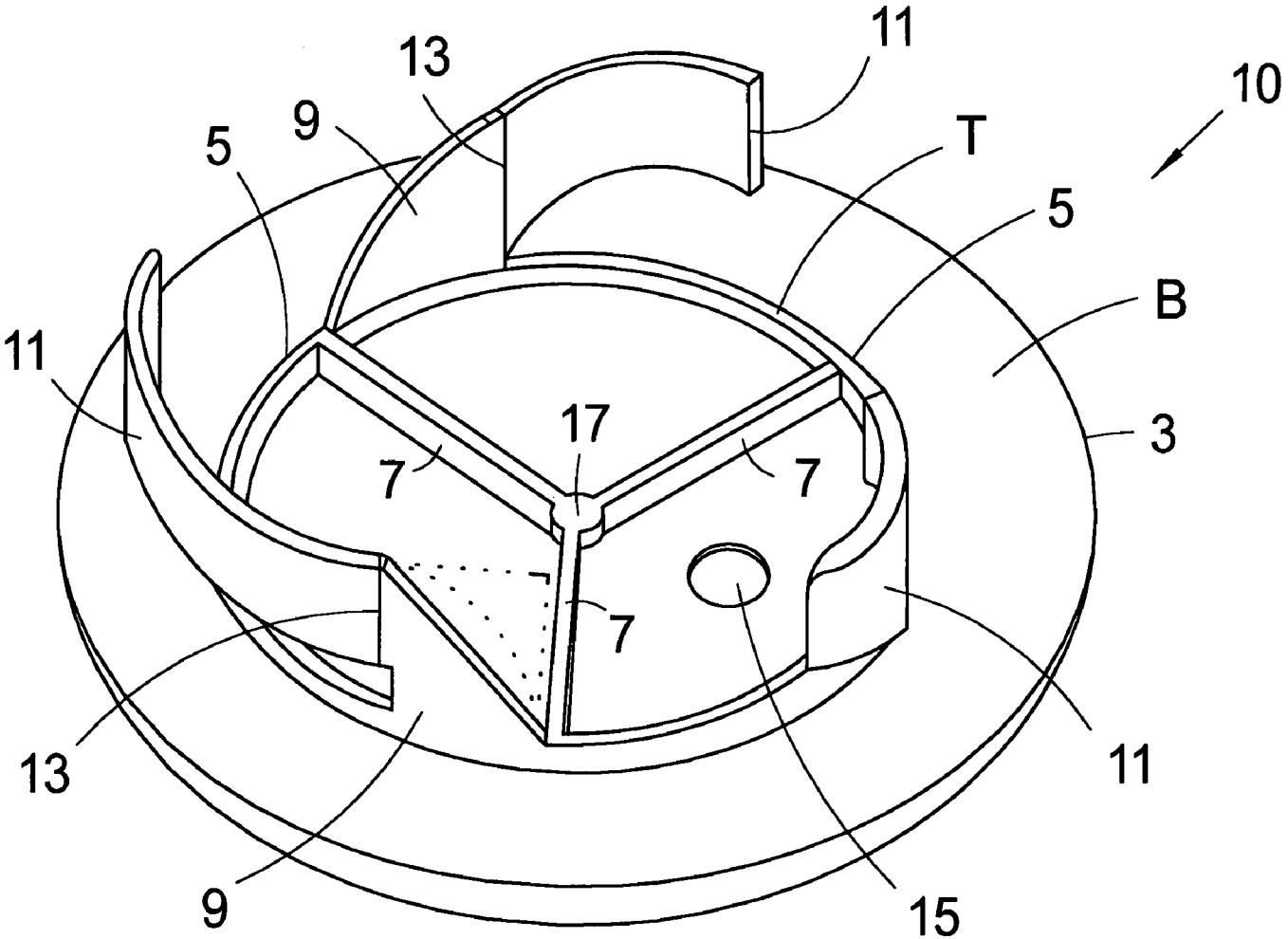
FIG. 1 shows a perspective view of the bottom of a cover according to one embodiment of the invention.

Referring to the drawings, and initially to FIG. 1 there is shown a perspective view of the bottom of a cover 10 according to one embodiment of the invention. In this FIG. 1 there is shown the base potion 3, which exists substantially in the form of a circular disc, having a bottom surface B, which in one preferred form of the invention is flat. Attached to the bottom surface B of the base portion 3 is a circular rib 5, which is disposed to protrude or project upwardly from the bottom surface B. In one embodiment, the circular rib 5 has a rectangular cross section and has a top surface T. In one embodiment, the top surface T is planar and is substantially parallel to the bottom surface B of the base portion 3. In one preferred embodiment, the circular rib 5 is disposed annularly, so as to form a ring, which ring may be located at any point between the center of the base potion 3 and the outer edge of the base portion 3. In a preferred embodiment, the circular rib 5 is disposed to be present on the bottom surface B of the base portion 3 at any location that is distanced between about one-twelfth of the radius of the base portion 3 and three-fourths of the radius of the base portion 3, from the outer circumferential edge of the base portion 3. For example, in one embodiment, when the base portion 3 has a radius of 10 centimeters, the circular rib 5 may be disposed at any location that is between about ten-twelfths ($^{10}/_{12}$) centimeters from the outer circumferential edge of the base portion 3, and 7.5 centimeters from the outer circumferential edge of the base portion 3. In one preferred embodiment, the base portion 3 has a radius of 10 centimeters, and the circular rib 5 is disposed at a location that is about 3 centimeters from the outer edge of the base portion. The location of the circular rib 5 from the circumferential edge of the base portion may be measured from any point on the top surface T of the circular rib, including the inner edge, outer edge, or any point therebetween. In one embodiment, the circular rib 5 has a width dimension of between two millimeters and four centimeters, as viewed from its cross-section. This width dimension is also the width of the top surface T of the circular rib 5, when its cross section is rectangular, as in one embodiment. In one embodiment, the width of the circular rib is between about two millimeters and ten millimeters wide. In a preferred embodiment, the circular rib 5 has a width dimension of about four millimeters, as viewed from its cross-section, corresponding to the width of its top surface T and the cross section is rectangular, the circular rib being disposed so that the midpoint of the width dimension of the circular rib 5 is distanced at a point about three centimeters from the outer circumferential edge of the base portion 3.

Disposed at the top surface T of the circular rib 5, and equally spaced thereabout, with regards to one another along the circular rib 5, are a plurality of risers 9. In one embodiment, the risers 9 extend upwardly, and in a direction that is away from the bottom surface B of the base portion 3, and can also be viewed as protruding upwardly from the circular rib 5, as shown in FIG. 1. The risers 9 are contoured to have a curvature, which substantially matches, and in one embodiment has congruent curvature with the circular rib 5, which embodiment having such congruent curvature can be seen readily from the bottom view in FIG. 2. In one embodiment, the risers 9 are each substantially triangular as viewed from a side perspective, with one of the legs of these triangles so defined being attached to and co-extensive with a segment of the circular rib 5, with the remaining leg of these triangles comprising intersections 13, each of which intersections 13 having disposed thereabout a contact shoe 11. The intersections 13 in one embodiment permit some movement of each of the contact shoes 13 independently from the relatively stationary position of the risers 9. FIG. 1 also shows a plurality of rib segments 7, extending from separate points on the inner wall of the circular rib 9 to a common center hub 17 which the rib segments intersect, the center hub 17 being shaped in the form of a cylinder and also being disposed on the bottom surface B of the base portion 3. These rib segments 7 may in one embodiment be analogous and identical to the circular rib in construction and cross-section, differing therefrom only in that they are linear, and are not annularly disposed on the bottom surface B of the base portion 3, but rather are disposed in the interior space defined by the circular rib 9, as shown. The rib segments 7 and center hub 17 provide added strength to the cover 10. There is also a hole 15, disposed through the base portion 3, which enables a user to lift the cover from an installed position by inserting their finger through the hole and pulling the cover upwards. The dotted lines in FIG. 1 show alternate embodiments of shapes of the risers 9 according to alternate embodiments, when the risers 9 are viewed from the side perspective, including risers having rectangular and smooth curved surfaces, in addition to embodiments in which the risers 9 appear substantially-triangular as viewed from the side, as described below.

A cover 10 according to the invention is preferably comprised of a material 20 having a reasonable strength, and suitable materials include stainless steel, steel, aluminum, any metallic alloys, polymers, polyethylene, polypropylene, alpha olefin copolymers, thermoset resins, thermoplastic vulcanizates, fiberglass, wood, composites, pressed wood fiber composites, etc. It is especially preferred that a device according to the invention be fabricated from an injection-grade polypropylene, based on its strength and durability. However, any material having strength sufficient to support about 150 pounds without undergoing fracture when installed at the terminal end of a conduit at ground level is suitable for use in providing a cover 10 according to the invention. When polyolefins are employed as the material of construction, it is possible to provide a cover 10 according to one or more embodiments, in which a cover 10 as shown in FIG. 1 is made of unitary construction, that is—wherein all elements described above are present on a single injection molded piece. Thus, the cover 10 shown in FIG. 1, in one preferred embodiment, is a single molded article.

Figure 2:
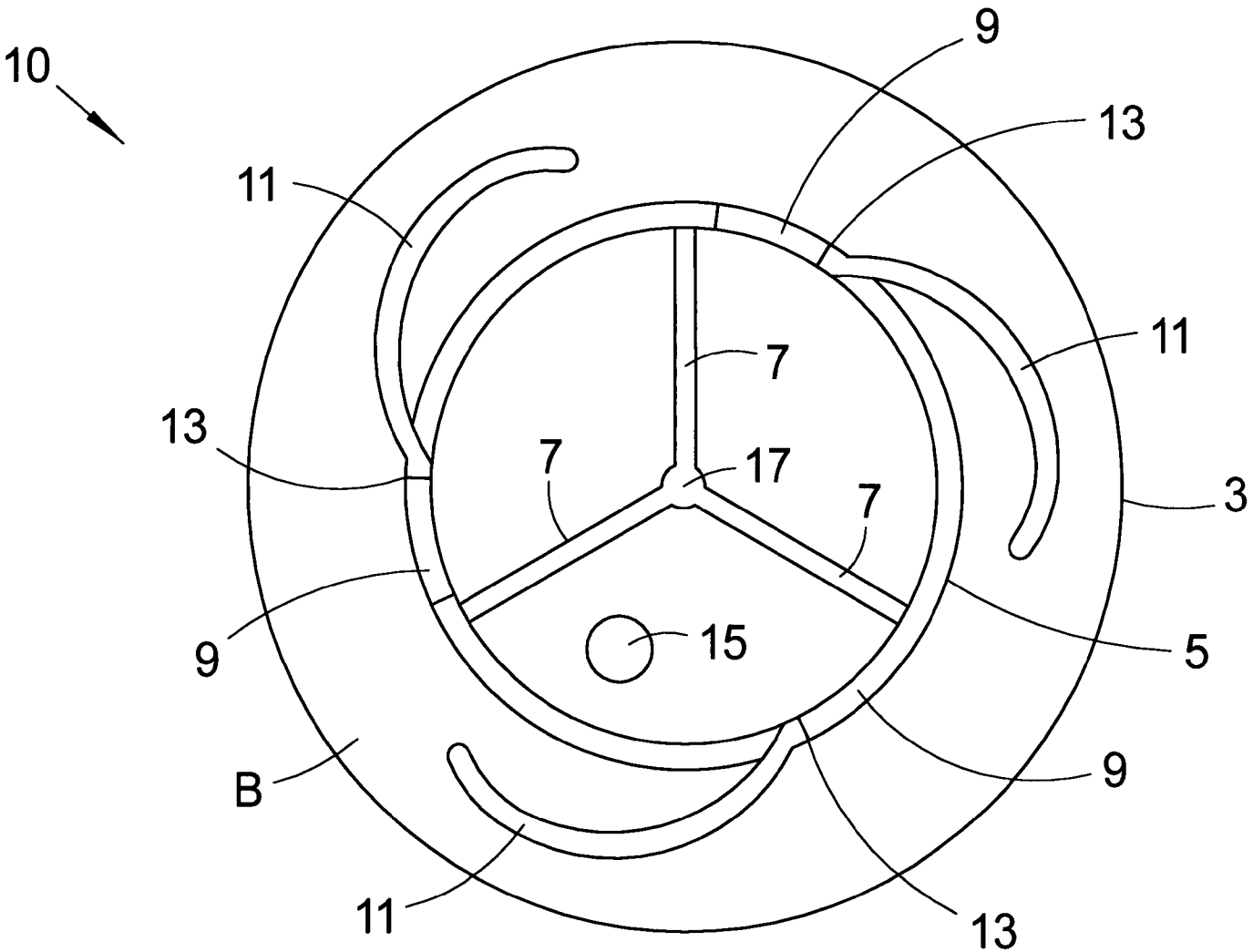
FIG. 2 shows a bottom view of a cover according to one embodiment of the invention.

In FIG. 2 is shown a bottom view of a cover 10 according to one embodiment of the invention. The respective locations of the base portion 3, circular rib 5, risers 9, and contact shoes 11 are shown, as well as the rib segments 7 and center hub 17. Also shown are the intersections 13, which are the locations at which the contact shoes 11 are attached to the risers 9. The risers 9 are contoured to have a curvature which substantially matches that of the circular rib 5. In one embodiment, the contact shoes 11 comprise an outer convex surface, and an inner concave surface, and the contact shoes 11 overall contour collectively departs from coinciding with the circular rib 5 as viewed from the bottom view of FIG. 2, as shown therein. Having the contact shoes 11 contoured in such fashion, coupled with their being attached to the risers 9 at the intersections 13 permit some movement of each of the contact shoes 13 independently from the relatively stationary position of the risers 9 in a direction shown by the double headed arrow depicted in FIG. 5, which movement is generally describable as being towards and away from the center of the base portion 3. By such configuration, the contact shoes 11 can each be pushed slightly towards the center point of the base portion 3, and when this is done, they will resist such pushing slightly and have a slight mechanical bias back towards their original position. This effect is of utility, when the inside diameter of the terminal portion of a conduit which is desired to be covered is slightly less than the diameter of an imaginary circle drawn to be tangential to each of the contact shoes 11, for in such case, one may push or compress the contact shoes inwardly towards the center point of the base portion 3, and insert the assembly having the contact shoes 11 so compressed into the conduit, so that the bottom surface B of the base portion 3 is facing the interior of the conduit. Upon release, and after being positioned within the confines of such a conduit, the contact shoes, by their inherent mechanical bias, from the energy stored by their compression, will exert a force that is oriented in a direction that is pointed outwardly from the centerpoint of the base portion 3, towards the inner wall W (FIG. 6) of such a conduit, until the contact shoes 11 contact the inner wall of the conduit, thus providing a securing force for the cover 10 in its installed position at the terminal end of the conduit.

Figure 3:
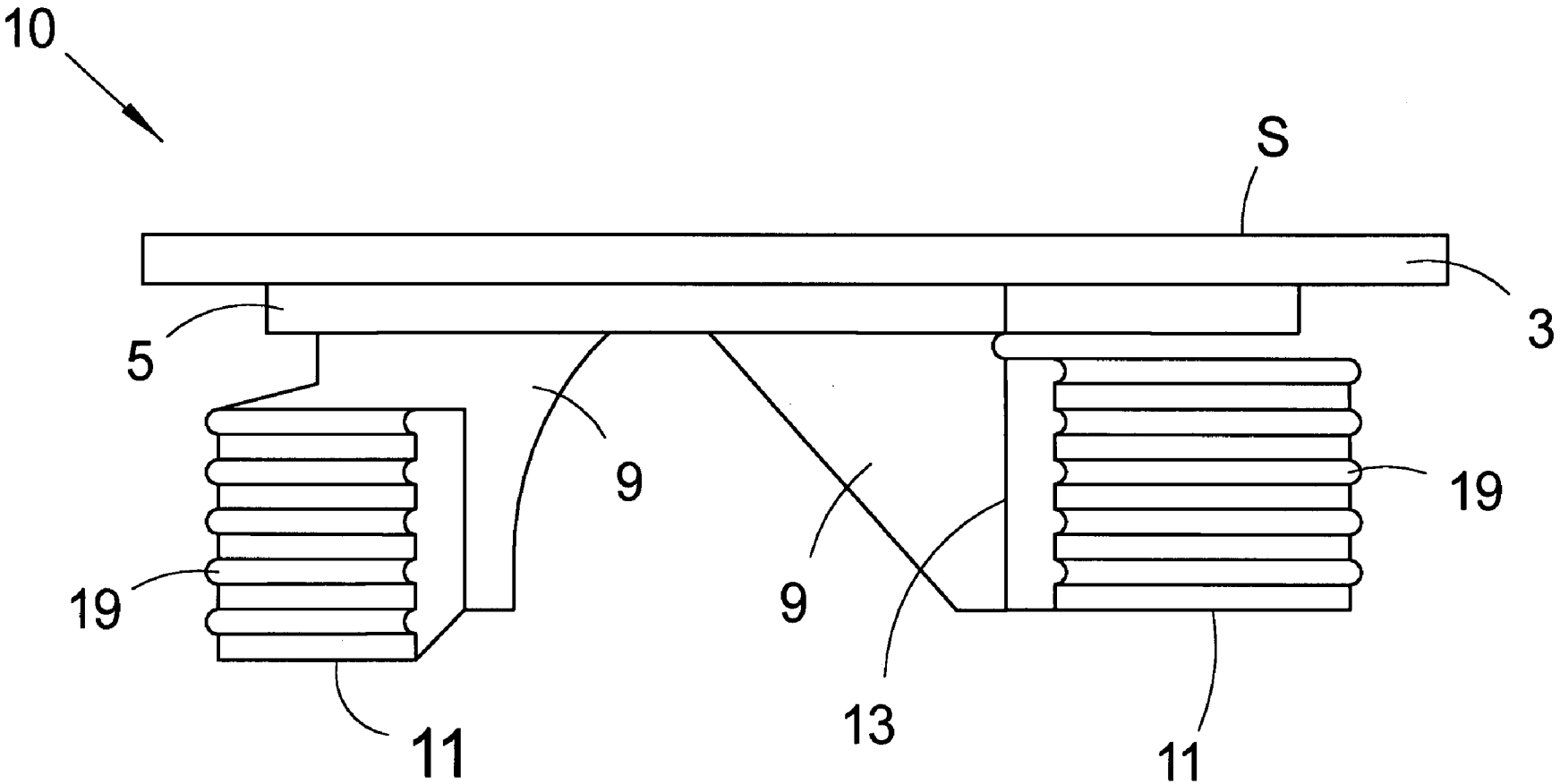
FIG. 3 shows a side perspective view of a cover according to one embodiment of the invention.

In FIG. 3 is shown a side perspective view of a cover 10 according to one embodiment of the invention, showing the respective locations of the base portion 3 and its top surface S, the circular rib 5, risers 9, contact shoes 11, and intersection 13. In one embodiment, the convex surfaces of the contact shoes 11 may have a texture on them, which texture may include knurling or ribs 19, cast or machined onto the convex surface of the contact shoes 11. Although described as being shaped substantially triangular as viewed from a side perspective such as that in FIG. 3, the risers 9 may have other shapes as well, including rectangular, or any irregular shape, with a main proviso, in one embodiment, being that the risers 9 should be connected to the circular rib along one of their edges, and should also have a contact shoe 11 disposed at another of its edges, so that the longest length dimension of the contact shoe is disposed to be substantially parallel to the bottom surface B of the base portion 3.

Figure 4:
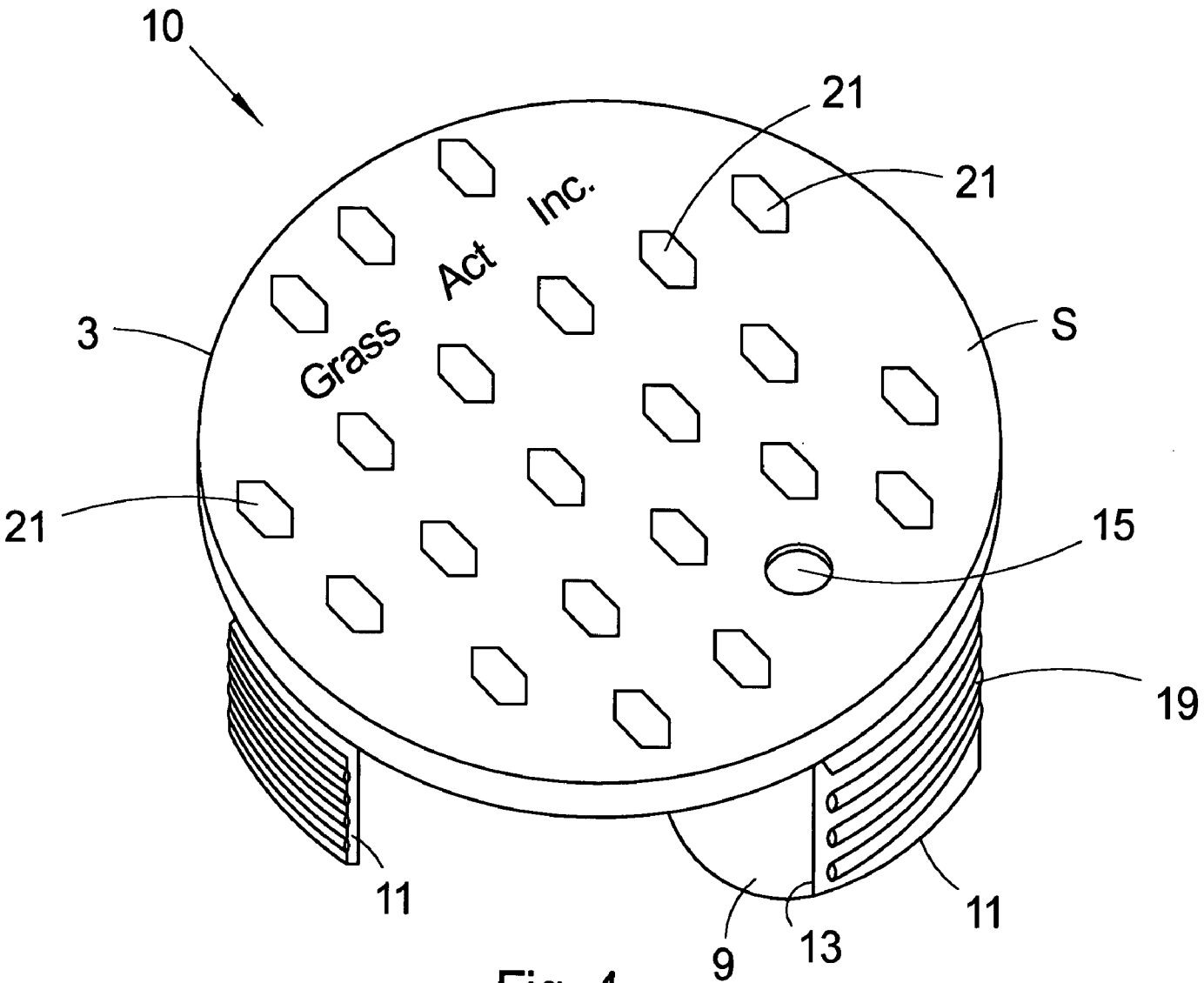
FIG. 4 shows a perspective view of the top of a cover according to one embodiment of the invention.

FIG. 4 shows a perspective view of the top of a cover 10 according to one embodiment of the invention, showing the respective locations of the base portion 3 and its top surface S, riser 9, contact shoes 11 having texture ribs 19, and intersection 13. Hole 15 is shown, as well as optional surface texture 21. The optional surface texture 21 may be any irregularity on the top surface S, including depressions, or protrusions, in any shape, including cross-hatchings, knurling, or depressions or protrusions of any geometric shape disposed in any pattern on the top surface S.

Figure 5:
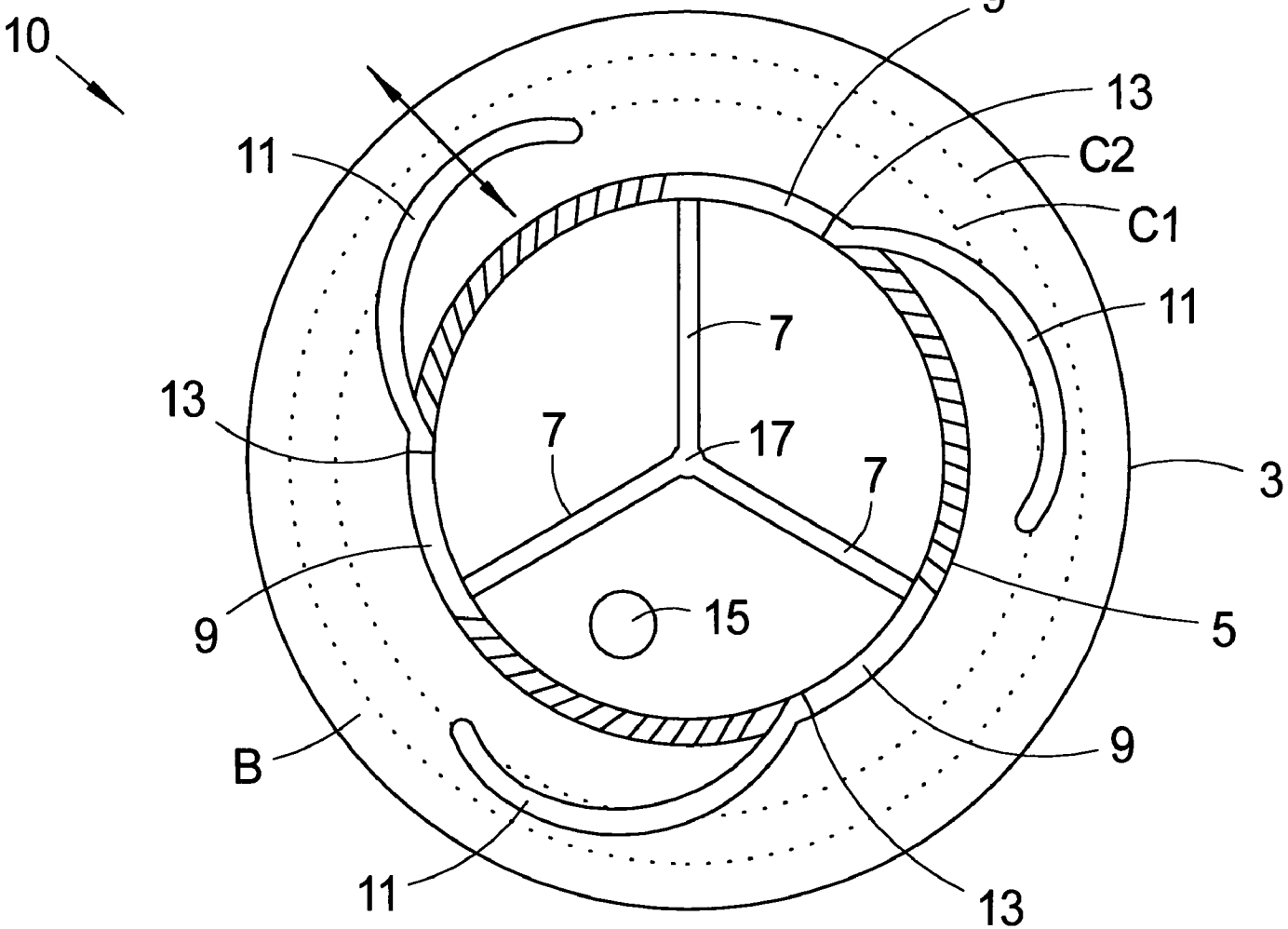
FIG. 5 shows bottom perspective view of a cover according to one embodiment of the invention.

In FIG. 5 is shown a bottom view of a cover 10 according to one embodiment of the invention. In this embodiment, the respective locations of the base portion 3, circular rib 5, risers 9, and contact shoes 11 are shown, as well as the rib segments 7 and center hub 17. Also shown are the intersections 13, which are the locations at which the contact shoes 11 are attached to the risers 9. From this view, the risers 9 are seen to be contoured to have a curvature which substantially matches that of the circular rib 5. In one embodiment, the contact shoes 11 comprise an outer convex surface, and an inner concave surface, and the overall contour of the contact shoes 11 collectively departs from coinciding with the circular rib 5, as compared with the risers 9. Having the contact shoes 11 contoured in such fashion, coupled with their being attached to the risers 9 at the intersections 13 permit movement of each of the contact shoes 13 in a direction shown by the double headed arrow, which potential movement is generally describable as being either towards or away from the center of the base portion 3. By such configuration, the contact shoes 11 can each be pushed slightly towards the center point of the base portion 3, and when this is done, they will resist further such pushing slightly and acting analogously to springs, each will have a slight mechanical bias back towards their original position following application of an unbalanced force, such as pushing. This effect is of utility, when the inside diameter of the terminal portion of a conduit which is desired to be covered, such as that defined by dashed circle $C_1$, is slightly less than the diameter of an imaginary circle drawn to be tangential to each of the contact shoes 11 when in their equilibrium position (with no force applied), such as dashed circle $C_2$, for in such case, one may push or compress the contact shoes inwardly towards the center point of the base portion 3, and insert the assembly having the contact shoes 11 so compressed into the conduit (FIG. 6), so that the bottom surface B of the base portion 3 is facing the interior of the conduit. Upon release, and after being positioned within the confines of such a conduit, the contact shoes, by their inherent mechanical bias, from the energy stored by their compression, will exert a force that is oriented in a direction that is pointed outwardly from the centerpoint of the base portion 3, towards the inner wall W (FIG. 6) of such a conduit, until the contact shoes 11 contact the inner wall of the conduit, thus providing a securing force for the cover 10 in its installed position at the terminal end of the conduit. Shown in FIG. 5 also are the locations of the rib segments 7, center hub 17, and hole 15.

According to an alternate form of a cover provided herein, the segments of the circular rib 5 containing hash marks in FIG. 5 may be omitted, in which embodiments the circular rib 5 will then instead be replaced with a structure comprising a plurality of rib segments, each of which rib segments have a riser and contact shoe attached thereto as hereinbefore described. The location of such rib segments so resulting may be disposed in any location earlier specified for the circular rib itself, with respect to the outer circumferential edge of the base portion 3.

Figure 6:
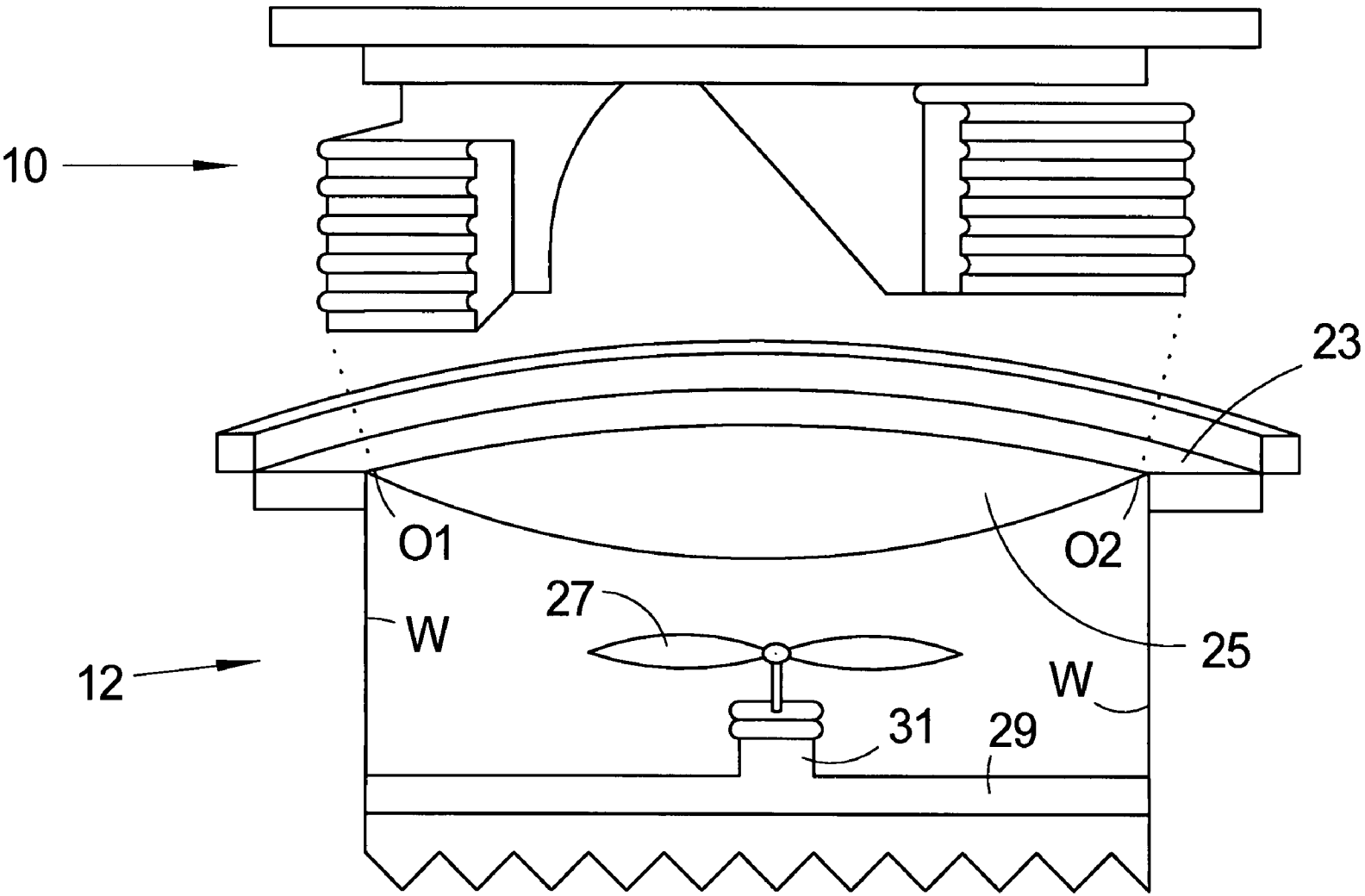
FIG. 6 shows a side perspective view of a cover according to one embodiment of the invention and its relation to an access conduit which it is intended to be capable of covering.

FIG. 6 shows a side perspective view of a cover 10 according to one embodiment of the invention and its relation to an access conduit 12 which it is intended to be capable of covering. The access conduit 12 is typically disposed in a subterranean location, with its terminal end or lip portion 23 being at ground level. The conduit 12 has an opening 25, at its terminal end, as is known in the art. In typical installations, there is disposed within the conduit a control device, which may be a switch, valve or the like. In FIG. 6, the control device is a valve 31 having a handle 27, which controls the flow of water through pipe 29, which may be a water pipe. In one embodiment, the lip 23 of the conduit 12 is contoured to be capable of receiving the circumferential edge of the cover 10 so as to render the cover/conduit assembly to have a flat top surface, with the top surface S (FIG. 4) of the base portion comprising that flat top surface. The opening 25 of the conduit 12 has a diameter dimension that is exemplified by the points $O_1$ and $O_2$ at opposite points along the terminal portion of the conduit. In one embodiment, the distance between points $O_1$ and $O_2$ of the conduit 12 corresponds to the diameter of dashed circle $C_1$ in FIG. 5. However, dashed circle $C_1$ shall not be construed as being a boundary of the movement of the contact shoes 11, and the scope of their motion includes extension inwardly all the way to the circular rib 5. Thus, to install cover 10 onto the opening of the conduit 12, one may manually press the contact shoes 11 inward towards the center hub 17 of the cover 10, and place the portion of the cover 10 which comprises the contact shoes 11 into the opening of the conduit. The pressing on the shoes is released, thus causing the contact shoes 11 to press outwardly against the wall W, securing the cover 10 fixed in position by the outward mechanical bias of the contact shoes 11. The cover 10 is then pressed downward so that the circumferential edge of the base portion 3 rests within the lip portion 23 of the conduit 12. To remove the cover 10 from a conduit once installed, one merely places a finger through the hole 15 (FIG. 4) and pulls the cover 10 away from the conduit 12.

Although shown and described as having three risers 9 and contact shoes 11, alternate embodiments of a cover 10 includes embodiments having two, four, five, six, and more of such combinations disposed along a circular rib 5 as described herein for the embodiments having three of such combinations. Preferably, such pluralities of risers and contact shoes are spaced equidistantly from one another along the circular rib 9.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. This includes subject matter defined by any combination of any one of the various claims appended hereto with any one or more of the remaining claims, including the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claims so modified. This also includes combination of the features and/or limitations of one or more of the independent claims with features and/or limitations of another independent claims to arrive at a modified independent claim, with the remaining dependent claims in their original text being read and applied to any independent claim so modified. Accordingly, the presently disclosed invention is intended to cover all such modifications and alterations, and is limited only by the scope of the claims which follow.

I claim:

1. A cover useful for covering an open end of a tubular access conduit, which comprises:

a) a substantially-circular, disc-shaped base portion having a top surface, a bottom surface, and a circumferential edge;

b) a circular rib disposed on said bottom surface of said base portion, wherein said circular rib itself has a top surface which is in a raised disposition with respect to said bottom surface, said circular rib forming a ring of raised elevation on said bottom surface;

c) a plurality of risers attached to and extending upwardly from said circular rib;

d) a plurality of contact shoes, each of which contact shoes are attached to one and only one of said risers, said contact shoes each having a textured convex outer surface, and a curvature which is different from the curvature of said circular rib, when said cover is viewed from the bottom perspective, and wherein said cover is a single injection-molded article.

2. A cover according to claim 1 wherein said circular rib is disposed on the bottom surface of said base portion at any location that is distanced between about one-twelfth of the radius of said base portion and three-fourths of the radius of said base portion from the outer circumferential edge of said base portion.

3. A cover according to claim 1 wherein the top surface of said circular rib is planar, and said top surface of said circular rib is parallel to the bottom surface of said base portion.

4. A cover according to claim 1 wherein said convex outer surface of said contact shoes comprises a plurality of ribs.

5. A cover according to claim 1 wherein said risers are substantially triangular when viewed from the side perspective.

6. A cover according to claim 1 wherein said risers are substantially rectangular when viewed from the side perspective.

7. A cover according to claim 1 wherein said risers comprise a smooth curved surface when viewed from the side perspective.

8. A cover according to claim 1 wherein said contact shoes are substantially rectangular when viewed from the side perspective.

9. A cover according to claim 1 further comprising a plurality of rib segments disposed within the ring defined by said circular rib, said rib segments each having:

i) a first end portion which intersect one another at the centerpoint of said base portion; and ii) a second end portion which is in contact with said circular rib.

10. A cover according to claim 1, further comprising a hole disposed through said base portion, said hole having a diameter sufficient to admit a human finger.

11. A cover according to claim 1 wherein said top surface of said base portion includes a surface texture.

12. A cover according to claim 11 wherein said texture includes a plurality of depressions.

13. A cover according to claim 11 wherein said texture includes a plurality of protrusions.

14. A cover useful for covering an open end of a tubular access conduit, which comprises:

a) a substantially-circular, disc-shaped base portion having a top surface, a bottom surface, and a circumferential edge;

b) a plurality of circular rib segments disposed on said bottom surface of said base portion;

b) a plurality of risers, each of said risers being attached to one of said circular rib segments, said risers extending away from said bottom surface of said base portion;

c) a plurality of contact shoes, each of which contact shoes are attached to one of said risers, said contact shoes comprising a convex outer surface which is textured, wherein the contact shoes are contoured to not coincide with the contour of the rib segment to which they are attached, when said cover is viewed from the bottom perspective, and wherein said cover is a single injection-molded article.

15. A cover according to claim 14 wherein said circular rib segments are disposed on the bottom surface of said base portion at any location that is distanced between about one-twelfth of the radius of said base portion and three-fourths of the radius of said base portion from the outer circumferential edge of said base portion.

* * * * *